US005590511A

United States Patent [19]

Morrison

[11] Patent Number: 5,590,511

[45] Date of Patent: Jan. 7, 1997

[54] AUTOMATIC CUTTER ADJUSTMENT

[75] Inventor: Robert Morrison, Spartanburg, S.C.

[73] Assignee: Milliken Packaging Corporation, Whitestone, S.C.

[21] Appl. No.: 520,660

[22] Filed: Aug. 22, 1995

[51] Int. Cl.[6] ..... B65B 9/20; B65B 51/16; B65B 51/26

[52] U.S. Cl. ..... 53/552; 53/374.4; 83/559; 83/592

[58] Field of Search ..... 53/451, 551, 389.3, 53/374.4, 51; 83/559, 592; 74/840, 841

[56] References Cited

U.S. PATENT DOCUMENTS

| | | | |
|---|---|---|---|
| 2,738,631 | 3/1956 | Jarund | 53/551 |
| 2,784,540 | 3/1957 | Jarund | 53/551 |
| 2,855,977 | 10/1958 | Wagner | 53/374.5 X |
| 2,962,843 | 12/1960 | Hoelzer et al. | 53/551 X |
| 2,969,628 | 1/1961 | Irmscher | 53/451 |
| 3,163,971 | 1/1965 | Loliger et al. | 53/451 X |
| 3,269,085 | 8/1966 | Czajkowski | 53/389.3 X |
| 3,546,835 | 12/1970 | Mobley | 53/451 |
| 5,351,464 | 10/1994 | Francioni | 53/550 X |

FOREIGN PATENT DOCUMENTS

| | | | |
|---|---|---|---|
| 2212421 | 9/1973 | Germany | 53/551 |

*Primary Examiner*—Horace M. Culver
*Attorney, Agent, or Firm*—Terry T. Moyer; Earle R. Marden

[57] ABSTRACT

A machine to produce filled packages having transverse seals at the top and bottom thereof created by severing a seal area between formed packages by cutting blades the position of which can be adjusted during running of the machine to vary the heights of the transverse seals. The adjustment of seal is caused by movement of a sliding bar member which causes the chain drive of the cutting mechanism to rotate in one direction or the other to move the cutting point of the blade relative to the uncut seal between adjacent packages.

5 Claims, 4 Drawing Sheets

FIG. —1—

AUTOMATIC CUTTER ADJUSTMENT

This invention relates to an apparatus and method to adjust the position of the seal cutter in a packaging machine producing filled packages from roll stock such as paper, film, etc.. In particular, the invention relates to the adjustment of the cutters in a tetrahedron producing package machine.

Machines which are designed to produce cushion shaped, parallelepipedic, or tetrahedral packages from a continuous roll or flat web of packaging material are well known in the packaging industry. Commonly, such machines are of the "form-fill-seal" variety, in which a continuous flat web of suitable packaging material, e.g., wax or plastic-coated paper which has been pre-printed with a label, is formed into a vertically oriented tube-like structure. This is accomplished by passing the web through one or more ring-like guides and forming a vertical seam by adhesively joining the longitudinal edges of the web. This tube is then filled with the desired product. By compressing opposing sides of the tube in the presence of an adhesive or, more commonly, heat, the tube may be transversely sealed as the tube moves through the machine, thereby forming individual packages. The separate, connected packages may then be separated from one another by cutting the tube in the region of the transverse seams.

In the production of certain packaged products as shown in FIG. 2, it is desired to have a longer upper seal 40 as compared to the lower seal 42 to provide space for the consumer to grasp the upper seal in order to easily open the package. To change the relation of the width of the upper and lower seals, prior to this invention, it was necessary to stop the machine and manually vary the position of the cutter blades to accomplish the desired ratio of the length of the upper seal to the lower seal. This manual changeover consumed a number of hours resulting in lost production of the packaging machine.

It is therefore an object of the invention to provide a packaging machine which allows easy and efficient modification of the position of the cutting mechanism to change the ratio of the length of the upper seal to the length of the lower seal.

Details and advantages of this invention will become readily apparent from the following discussion, when read in conjunction with the accompanying figures, in which FIG. 1 is a schematic representation of a form-fill-seal packaging machine designed to make tetrahedral-shaped containers filled with product from a continuous web of suitable packaging material including the new and improved cutter adjustment mechanism;

Figure 1:
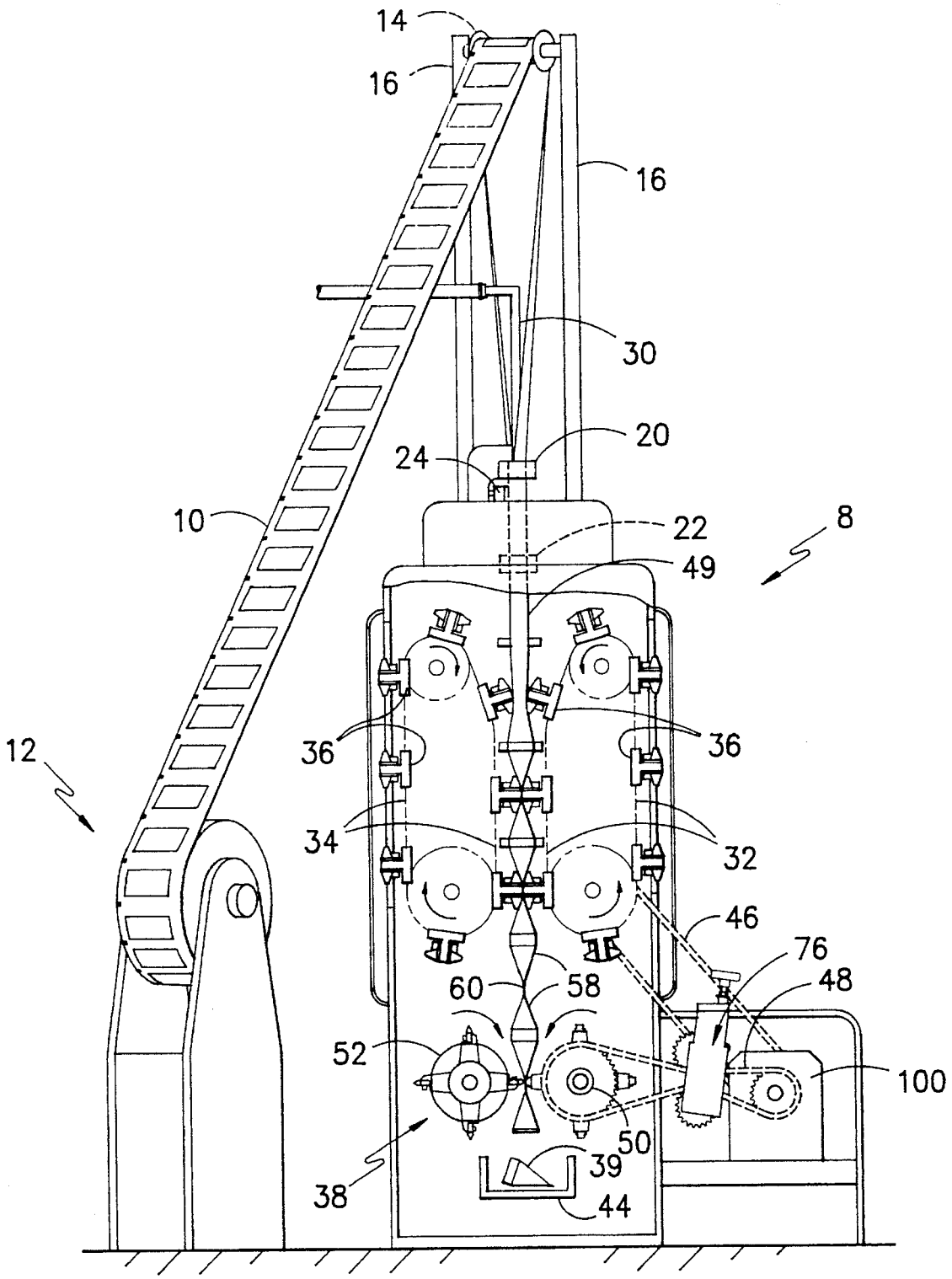

In the embodiment of the instant invention shown in FIG. 1, a typical tetrahedron forming machine 8 is shown which forms tetrahedron-shaped filled containers from a roll of pre-printed flat package stock, e.g., a polyethylene coated paper. The paper 10 is supported on a suitable support 12 and is delivered upwardly over guide rolls 14 supported by frame members 16 secured to the machine. The paper 10 is delivered downwardly through a oval collar 20 which longitudinally curls the paper 10 by bending the longitudinal edges of the sheet material toward one another. From the collar 20 the sheet material passes through a circular forming ring 22 where the overlap of the longitudinal edges is completed, and the package stock is in closed cylindrical (tube) form. An elongate heater 24 seals together the overlapped longitudinal edges with the assistance of a set of opposed rollers, not shown, between which the heated longitudinal edges are pressed together.

A fill pipe 30 is positioned to extend within the tube 49 of package stock, and extends to a point above the region where the transverse seals 60 are formed. To form the first and second transverse seals, two sets of endless chains carrying opposed heated sealing jaws 36 at fixed locations along the chains are continuously and uniformly rotated by driven sprockets. One set of endless chains is represented by reference numerals 32 and 34 while a second set of chains (not shown) is located parallel to the axis of the tubular sheet material and perpendicular to the first set of chains 32 and 34, i.e., to the front and rear of the view depicted in FIG. 1. As shown, the heating jaws 36 on the first set of chains form a transverse seal and simultaneously advance, via a pulling action, the tubular sheet material downwardly through the machine. The heating jaws on each set of chains are spaced two package lengths from one another, so that the heating jaws 36 on the second set of chains, located between, and axially displaced from, the heating jaws 36 on the first set of chains, have room to form a second transverse seal which is one package length away from and transverse to the first seal. Due to the staggered or interleaved relative positioning of the jaws on the first and second sets of chains, the top-most seal will be made by jaws carried on the first set of chains, then by jaws carried on the second set of chains, in alternating fashion. It can be seen that the continuously moving heating jaws form the first transverse seal in a region already occupied by product while the product is being supplied from the fill pipe, form the second transverse seal also in a region occupied by product, and supply a continuous chain of packages to a cutting means, generally designated 38, wherein the transverse seals 40 and 42 are formed by severing along the length of seal 60 to form individual packages 39 which are dropped into a suitable collection bin 44.

Figure 3:
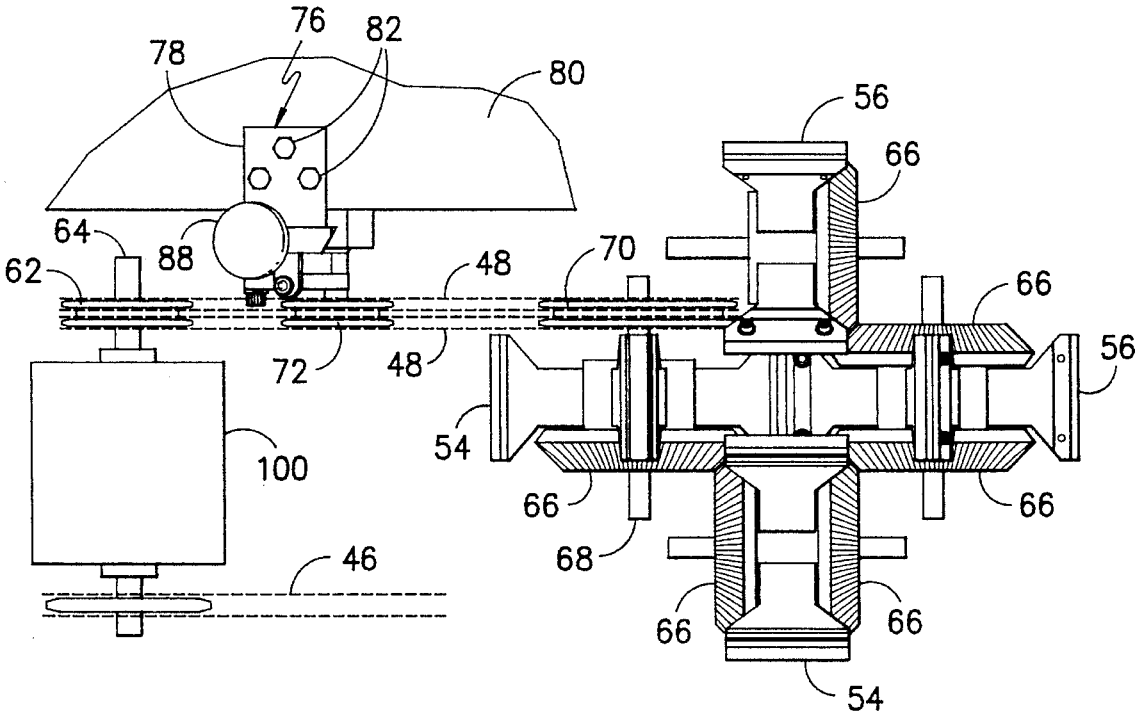
FIG. 3 is a top schematic representation for the chain drive for the heating jaws and cutting mechanism of the machine shown in FIG. 1.

As shown in FIGS. 1 and 3, the endless chains including 32 and 34 and the cutter mechanism 38 are driven respectively by chains 46 and 48 connected to the gear box 100. The chains 48 through a suitable sprocket and bevel gear arrangement shown in FIG. 3 rotates two sets of cooperating quadrant members 50 and 52.

The quadrant member 50, called a counterrail quadrant has four back-up members 54 connected thereto which cooperate with the four cutting blades 56 on the cutter quadrant 52 to sever the formed filled members 58 in the seal area 60 to form the individual filled packages 39 with the desired end seals 40 and 42. The sets of quadrant members are so mounted that the cutters of one set alternate with the cutters of the other set each to cut every other seal 60. The set of quadrant members (not shown in FIG. 1) shown in FIG. 3 are mounted in a plane perpendicular to the quadrant member 50 and 52 shown in FIG. 1 and operate in a manner similar to the heating jaws that form the tetrahedron package. In a known manner the cutting blade 56 of the cutter quadrant bears against the seal area 60 against the opposing back-up member 54 to sever the package in the seal area to form the package 39. As can be seen, the backing member 54 and cutting blades 56 on each quadrant are mounted at an angle of 90° with the next adjacent members of the set with the blades 56 and back-up members 54 of the set (not shown) being out of phase therewith to cut the next adjacent seal.

As mentioned previously, the chains 48 driven by sprockets 62 connected to shaft 64 of the gear box 100 drive or rotate the quadrant members 50 and 52 through suitable bevel gears 66 interengaged and rotated by the shaft 68 driven by chains 48 engaging the sprockets 70 mounted on the shaft 68.

Figure 4:
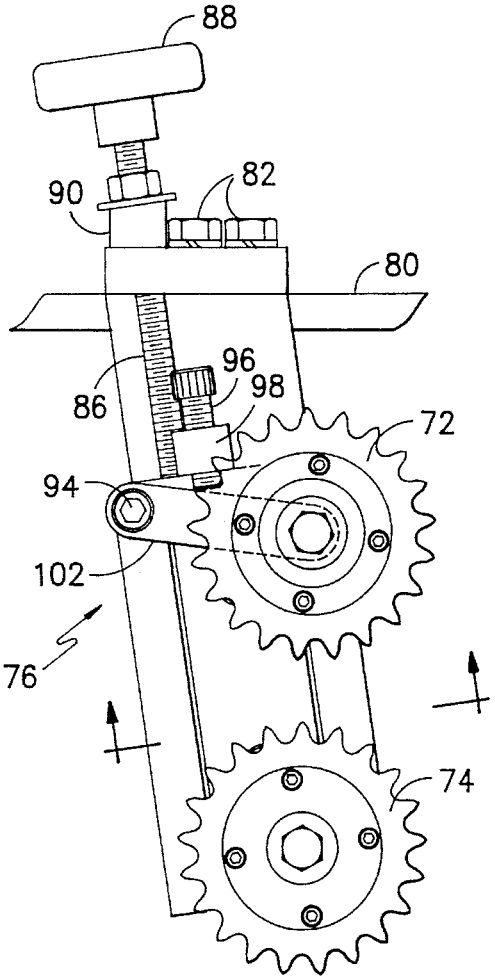
FIG. 4 is a partial side view of the cutter adjustment mechanism.
Figure 5:
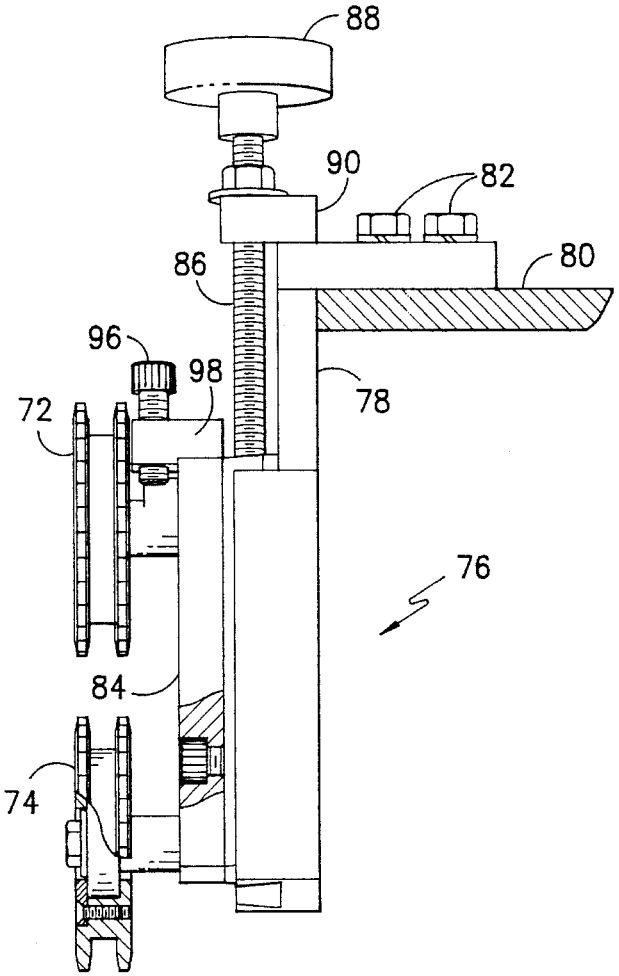
FIG. 5 is a front view of the cutter adjustment mechanism of FIG. 4.
Figure 6:
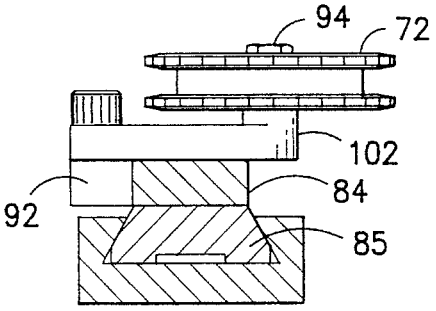
FIG. 6 is a cross-section view taken on line 6—6 of FIG. 4.

As shown in detail in FIGS. 3–8 the tension of the chains 48 is controlled by the sprockets 72 and 74 which the chains 48 pass in contact with as they travel from the gear box 100 to the cutting mechanism 38 and back. The sprockets 72 and 74 are rotatably mounted on the support member 76. The support member basically consists of fixed support 78 attached to frame 80 of the machine by suitable bolts 82 and a sliding support member 84 which forms a dovetail joint 85 as shown in FIG. 6. To move the sliding support member 84 up or down, a screw member 86 with an external handle 88 is threaded through the bar 90, mounted on the upper portion of the fixed support member 78 into the top of the support member 84.

The sprockets 72 and 74 are rotatably mounted to the sliding support member 84 so that they will slide therewith as the screw 86 is rotated to slide the member 84 up or down. The support member has a tab 92 extending therefrom to which the sprocket 72 is pivotally mounted at 94 while the sprocket 74 is mounted therebelow as shown in FIGS. 4 and 5. A screw member 96 is threaded thru the upper portion 98 of the sliding support 84 to engage the lever arm 102 to provide for positioning of the upper sprocket 72 to provide the desired operating tension in the chains 48.

Figure 2:
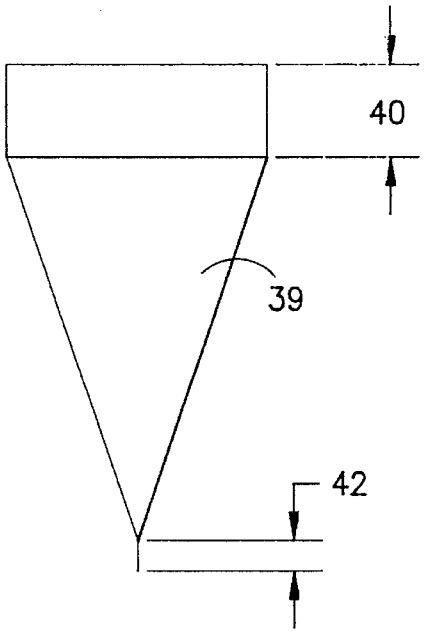
FIG. 2 shows a tetrahedron container made on the machine of FIG. 1 illustrating one desired variation of length of the upper and lower seals.

As discussed briefly before, the position of the sprockets 72 and 74 determine the cutting position of the blades 56 relative to the seal area 60. In packages like that shown in FIG. 2, it is desired to have upper seal 40 wider than the lower seal 42. Furthermore, in operation, the seal cutting mechanism gets out of adjustment during operation and has to be readjusted. Prior to this invention, it was necessary to stop the machine and physically move the cutting blades 56 and back-up member 54 into a pre-selected position. The machine then has to be started up again and checked, resulting in numerous starting and stoppings of the machine until the proper width seal is produced.

Figure 7:
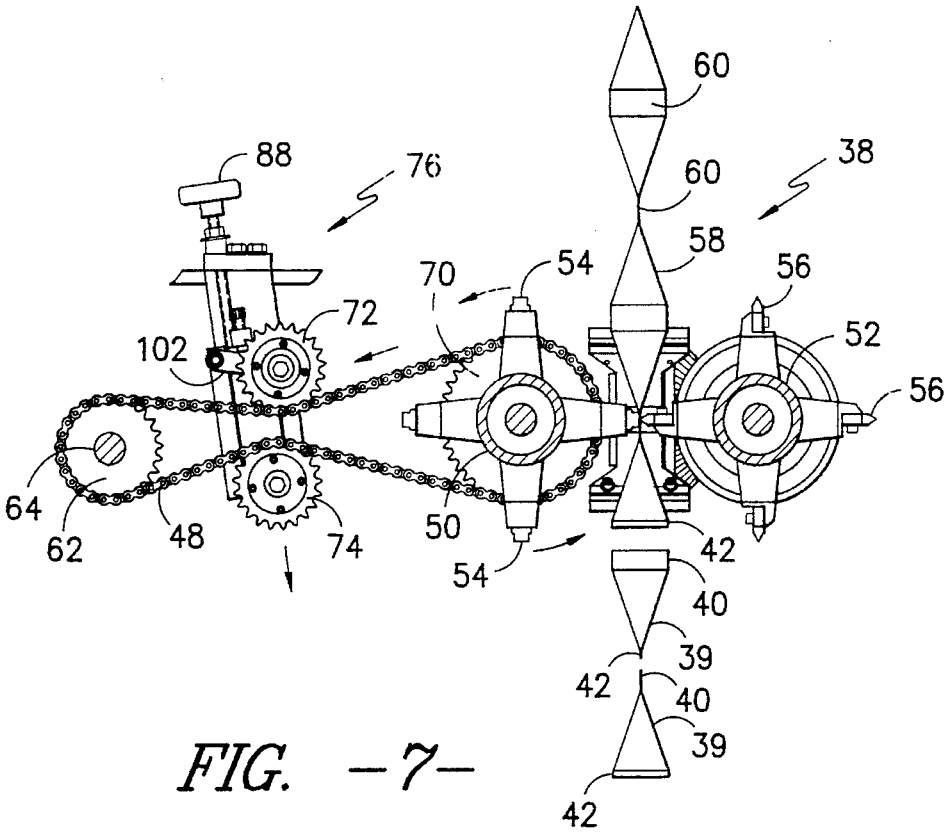
FIGS. 7 and 8 represent different operating positions of the cutter mechanism.
Figure 8:
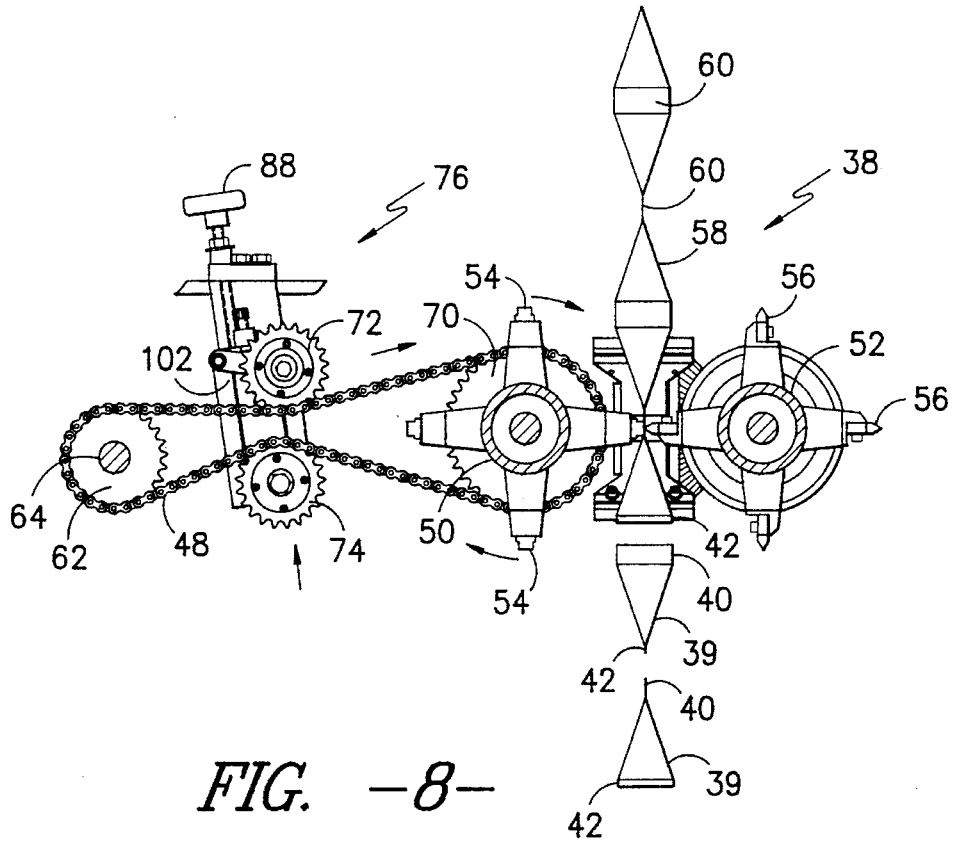

To alleviate the above mentioned problem, the adjusting mechanism, shown in FIGS. 3–5 and exemplified in FIG. 7, was developed to enable adjustment of the seal width while the machine is running thereby eliminating the lost production of the machine during downtime and also eliminating the production of a number of unusable packages. As exemplified in FIGS. 7 and 8 after the tension in the chains 48 has been adjusted by actuation of the screw member 96, the handle 88 is rotated to rotate the screw 86 to move the sliding block member 84 in the dovetail joint 85 up or down to rotate the quadrant members 50 in the counter-clockwise direction as shown in FIG. 7 or in the clockwise direction as shown in FIG. 8. This movement of the quadrant members 50 will shift the position of the back-up members 54 and the cutting blades 56 relative to seal area 60 to vary the heights of the seals 40 and 42 in the package 39 produced.

As can be seen, this adjustment can readily be made while the machine is running and the adjustment of the seals 40 and 42 can be readily observed without stopping the production of packages. The particular machine disclosed is a tetrahedron package producing machine with alternate seals 90° out of place with one another but the invention can readily be adapted to adjust the width of seals on a pillow pack machine in which all the seals are in the same plane.

Although the preferred embodiment has been specifically described it is contemplated many changes may be made without detracting from the scope or spirit of the invention and it is desired that invention be limited only by the claims.

I claim:

1. Apparatus to produce a filled package having transverse seals at both ends thereof comprising: means to supply a tube of packaging material, a second means to supply material to be packaged into said tube of said packaging material, a third means to form a transverse seal in said tube of material, a fourth means downstream of said third means severing said transverse seal to form a separated filled package and a bottom seal for said tube of material being moved towards said fourth means, said fourth means including a blade member and a back-up member to sever said transverse seal therebetween, said blade member and said back-up member each being mounted on a rotatably mounted support, said supports being driven by a chain member driven from a gear box, sprocket means engaging said chain member between said gear box and said rotatably mounted support members and means operably associated with said sprocket means to move said sprocket means up or down to rotate the cutting position of said blade and back-up members.

2. The apparatus of claim 1 wherein said sprocket means includes two sprocket members slidably mounted with respect to said chain member.

3. The apparatus of claim 2 wherein one of said sprocket members is pivotally mounted with respect to said other sprocket member.

4. The apparatus of claim 3 wherein said sprocket members are rotatably mounted in a sliding block member and said block member is mounted a second block member fixed to the frame of said machine.

5. The apparatus of claim 4 wherein a screw member is mounted in said second block member and engages said sliding block member to move said sliding block member upon rotation thereof.

* * * * *